US005632487A

United States Patent [19]

Nguyen

[11] Patent Number: 5,632,487

[45] Date of Patent: May 27, 1997

[54] METHOD OF PLAYING A CARD GAME WHEREIN RED SUIT OR BLACK SUIT CARDS ARE GIVEN PRIORITY

[76] Inventor: Son H. Nguyen, 11052 Stonecress, Fountain Valley, Calif. 92708

[21] Appl. No.: 609,719

[22] Filed: Mar. 1, 1996

Related U.S. Application Data

[63] Continuation-in-part of Ser. No. 574,645, Dec. 19, 1995.

[51] Int. Cl.[6] ..... A63F 1/00

[52] U.S. Cl. ..... 273/292; 273/274; 273/303

[58] Field of Search ..... 273/292, 303–306, 273/274, 309

[56] References Cited

U.S. PATENT DOCUMENTS

| | | | |
|---|---|---|---|
| 5,141,234 | 8/1992 | Boylan et al. | 273/292 |
| 5,397,128 | 3/1995 | Hesse et al. | 273/292 |
| 5,494,295 | 2/1996 | Potter et al. | 273/292 |
| 5,503,401 | 4/1996 | Nguyen | 273/306 |

OTHER PUBLICATIONS

"Bacc–Jack", Casino Gaming Concepts, Inc., 1995.
"Califorinia Baccarat", Casino Gaming Concepts, Inc. 1994.

*Primary Examiner*—Benjamin H. Layno
*Attorney, Agent, or Firm*—Kenton R. Mullins

[57] ABSTRACT

The method of playing a card game using a card deck of 360 cards which consists of 10 modified conventional decks. Each modified conventional deck has all seven, eight, nine, and ten cards removed therefrom. Thus, each modified conventional deck comprises only 36 cards. The card game is played according to either a red winning scheme wherein only the cards in the red suit are counted and totalled or a black winning scheme wherein only the cards in the black suit are counted and totalled. The banker may arbitrarily choose either winning scheme, the chosen winning scheme being, commom to all the players and banker After the winning scheme is determined, the first round of three cards is dealt face down to all players (betting players and banker). After all players have received their three cards, the players total the value of the cards in their hands that only belong to the chosen suit winning scheme. The cards belonging to the suit not chosen are not counted and are not totalled. The players then determine whether an additional card is desired. This determination will likely be affected by whether the red winning scheme or the black winning scheme has been set. The hands of the various players are then compared with the hands of the banker, and winners are declared who have hands that are better than the banker's hand, according to the selected predetermined winning scheme. Any hand between the players and the banker are push hands that are considered to be tie.

12 Claims, 5 Drawing Sheets

Fig. 1
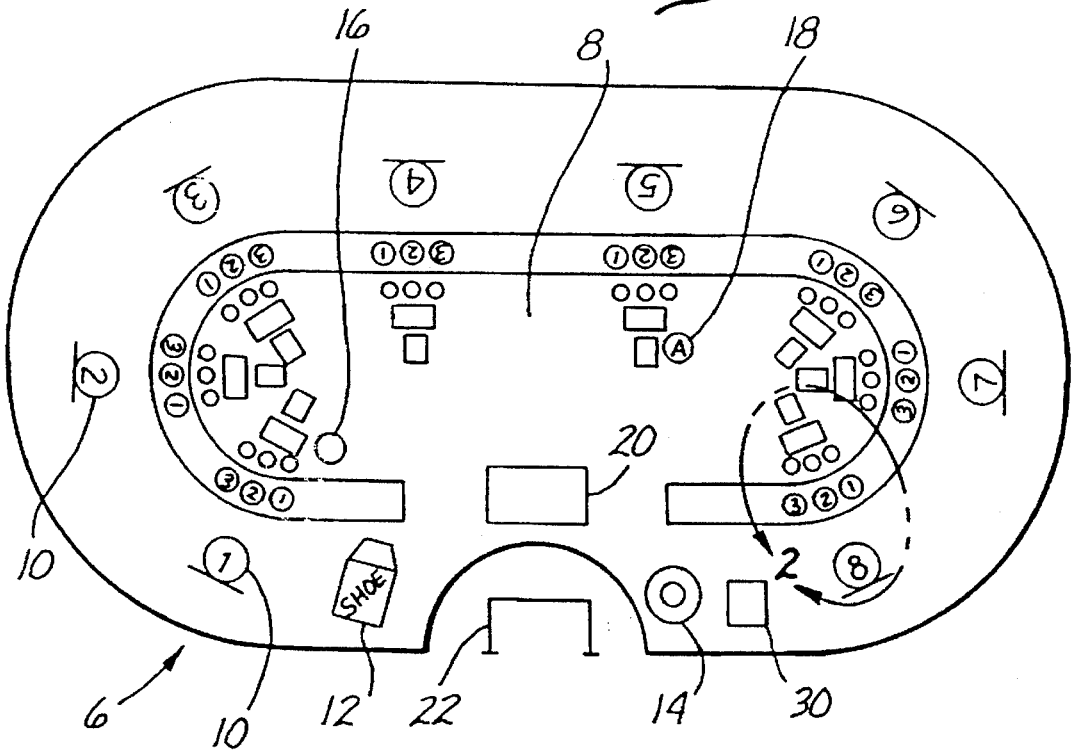
Fig. 2
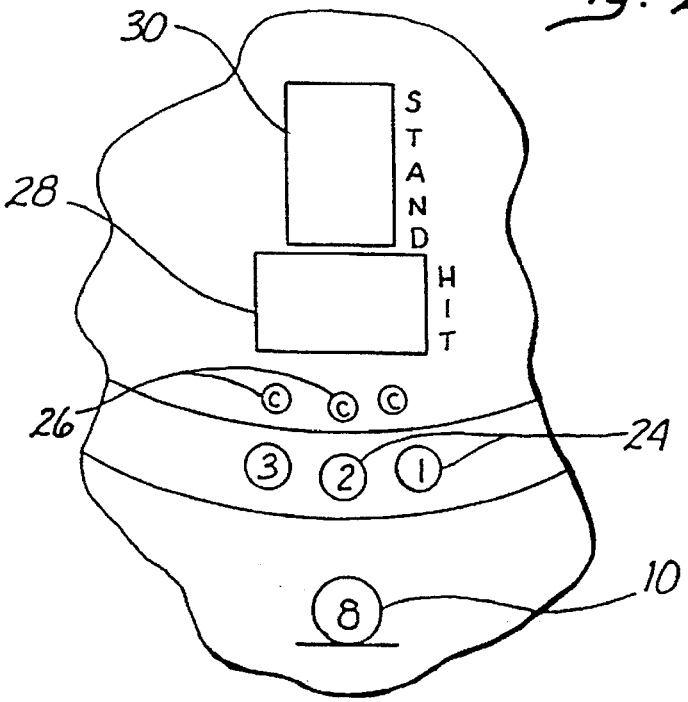
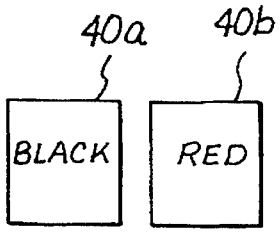
Fig. 3

METHOD OF PLAYING A CARD GAME WHEREIN RED SUIT OR BLACK SUIT CARDS ARE GIVEN PRIORITY

RELATED APPLICATION

This application is continuation-in-part of U.S. Ser. No. 08/574,645 filed Dec. 19,1995 and entitled Method of Playing Asian High-Low.

BACKGROUND OF THE INVENTION

1. Field of the Invention

The present invention generally relates to card games and, in particular, to card games utilizing customized decks of cards for use in casinos.

2. Description of Related Art

Card games have existed where players are dealt a number of cards and then have an option of receiving additional cards. The object of such a game is to score a predetermined number of points without going over this predetermined number. A well-known game where the object is to reach a value of twenty-one without going over this limit is Blackjack.

Applicants are aware of several card games which generally can be played in a casino-type environment. U.S. Pat. No. 5,072,946 to Miller discloses a casino-type card game involving two players. A card is dealt to each player, and when the numerical values of the cards are compared, a tie ends the game, or another card is dealt to the player with the lower numerical value hand. The player first reaching a predetermined numerical value eventually wins the game. Another patent, U.S. Pat. No. 5,265,882 to Malek discloses a casino-type card game wherein a player simultaneously plays at least two of three games against the dealer. This game is applicable to Twenty-One, modified Draw Poker, and Baccarat. U.S. Pat. No. 5,275,415 to Wisted discloses a Blackjack-type game among a plurality of players playing against each other with a dealer. The dealer, however, does not receive any cards. A final card game to Schorr et al., U.S. Pat. No. 5,275,416, discloses a Blackjack-type card game with at least one customer wagering a first bet on any one of a dealer betting station corresponding to the "dealer hand," a player betting station corresponding to the "player hand," and a tie betting station. None of these games, however, use modified card decks in combination with customized playing rules, as does the present invention.

SUMMARY OF THE INVENTION

The method of playing a card game of the present invention is operated among a plurality of players arranged about a table. The method uses a card deck of 360 cards which consists of 10 modified conventional decks. Each modified conventional deck comprises aces, twos, threes, fours, fives, sixes, Jacks, Queens, and Kings. Each modified conventional deck has all seven, eight, nine, and ten cards removed therefrom. Thus, each modified conventional deck comprises only 36 cards. Alternatively, a conventional 52 card deck, a deck with an added joker, or a set of 36 tiles (corresponding to the modified conventional deck) may be used. According to the method of the present invention, each of the plurality of players places a wager.

The card game is played according to either a red suits (as Hearts and Diamonds) winning scheme or a black suits (as Clubs and Spades) winning scheme. The banker may arbitrarily choose either winning scheme, or the winning scheme may be determined by a roll of the dice. After the winning scheme is determined, the banker rolls the three dice to determine the assignment of the action button. The assignment of the action button is determined from the number indicated by the rolled dice. The first round of three cards is dealt face down to all players (betting players and the banker, excluding the dealer). Alternatively, two cards are dealt if the game is played with a standard 52 card deck. After all players have received their first round of cards, each player determines whether an additional card is desired. This determination will likely be effected by whether the red suits winning scheme or the black suits winning scheme has been set. Any additional cards are dealt, beginning with a player seated to the immediate left of the banker. The hands of the various players are then compared with the hand of the banker, and winners are declared who have hands that are better than the banker's hand, according to the selected predetermined winning scheme.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

FIG. 1 shows a preferred layout of the card table of the present invention which is used in connection with the method of the present invention;

FIG. 2 is a close-up view of the playing area in front of a player position according to the presently preferred embodiment;

FIG. 3 shows two sides of the declare button, which is used to indicated whether the red suits winning scheme or the black suits winning scheme is being used;

DESCRIPTION OF THE PREFERRED EMBODIMENTS

Figure 4A:
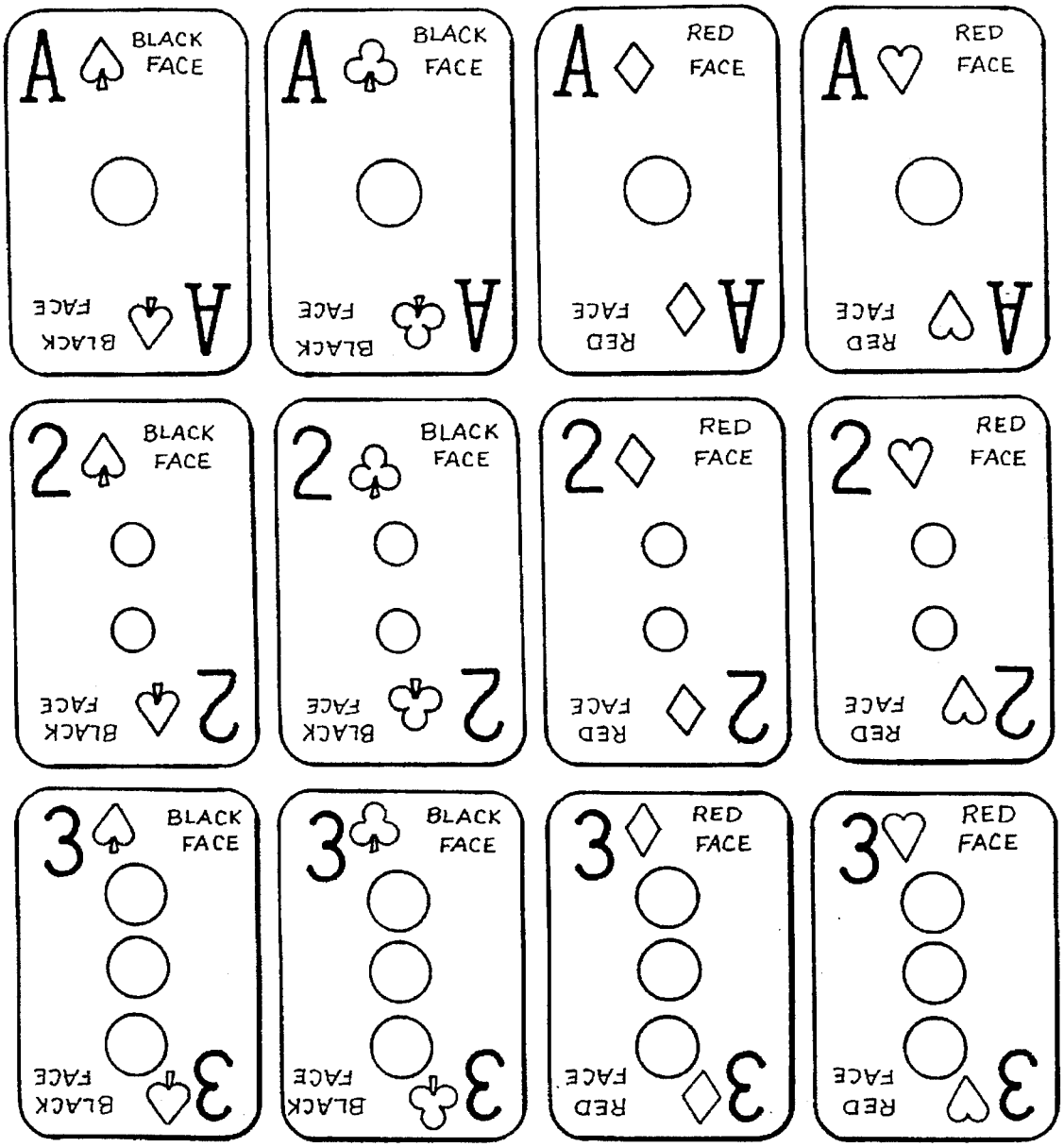
FIGS. 4*a* and 4*b* show a 36 card deck according to a first preferred embodiment of the present invention.

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein.

FIG. 1 shows the table 6 of the presently preferred embodiment which comprises a playing surface 8 located in a central portion thereof. Eight player positions 10 are positioned about the periphery of the table 6, and a house dealer's position 22 is positioned between two of the player positions 10. The house dealer's tray 20 is positioned in front of the house dealer's position 22. The house dealer's tray 20 can store chips used during play of the game of the presently preferred embodiment. A bank button 16 is positioned in front of one of the player positions 10 to indicate which player is currently serving as banker. Similarly, an action button 18 is positioned in front of one of the player positions 10 to indicate which player will first receive three cards and first compare his hand with the hand of the banker player 16. A cup, dice, and saucer 14 are provided to the right of the house dealer's position 22 on the playing surface 8.

The declare button 40 is positioned on the right hand side of the house dealer's position 22. The player banker can arbitrarily declare to play the game with either a red suits winning scheme (Hearts and Diamonds) or a black suits winning scheme (Spades and Clubs). Alternatively, the determination of whether a red suits winning scheme or a black suits winning scheme is to be used may be made by a roll of the dice. According to this approach, three dice are given to the banker, the banker shakes the three dice, and the house dealer opens the cup to display the sum of the three dice. If the sum of the three dice is between three and ten, the red suits winning scheme is used. If the sum of the three dice is between eleven and eighteen, the black suits winning scheme is used.

FIG. 2 shows a close-up view of the playing area in front of each player position 10. Wager circles 24 accommodate wagers, and collection circles 26 accommodate corresponding collections, as described in copending application "Method of playing a Card Game," U.S. Ser. No. 08/376,406, by the same inventor of this application and another. The hit box accommodates cards when the corresponding player wishes to draw another card, and the stand box accommodates the player's cards when the player does not wish to draw additional cards.

FIG. 3 shows the declare button 40 of FIG. 1. A first side 40*a* of the declare button indicates that the red suits winning scheme is being used, and the second side 40*b* of the declare button indicates that the black suits winning scheme is being used. Although the presently preferred embodiment uses a single two-sided declare button to indicate whether a red winning scheme or a black winning scheme is set, many other variations are possible. For example, four declare buttons may be used to indicate whether a Hearts, Diamonds, Spades, or Clubs winning scheme is set. In this embodiment, each button has a suit indicated on a face thereof, and the button with the chosen suit is placed face-up with the others placed face down.

Figure 4B:
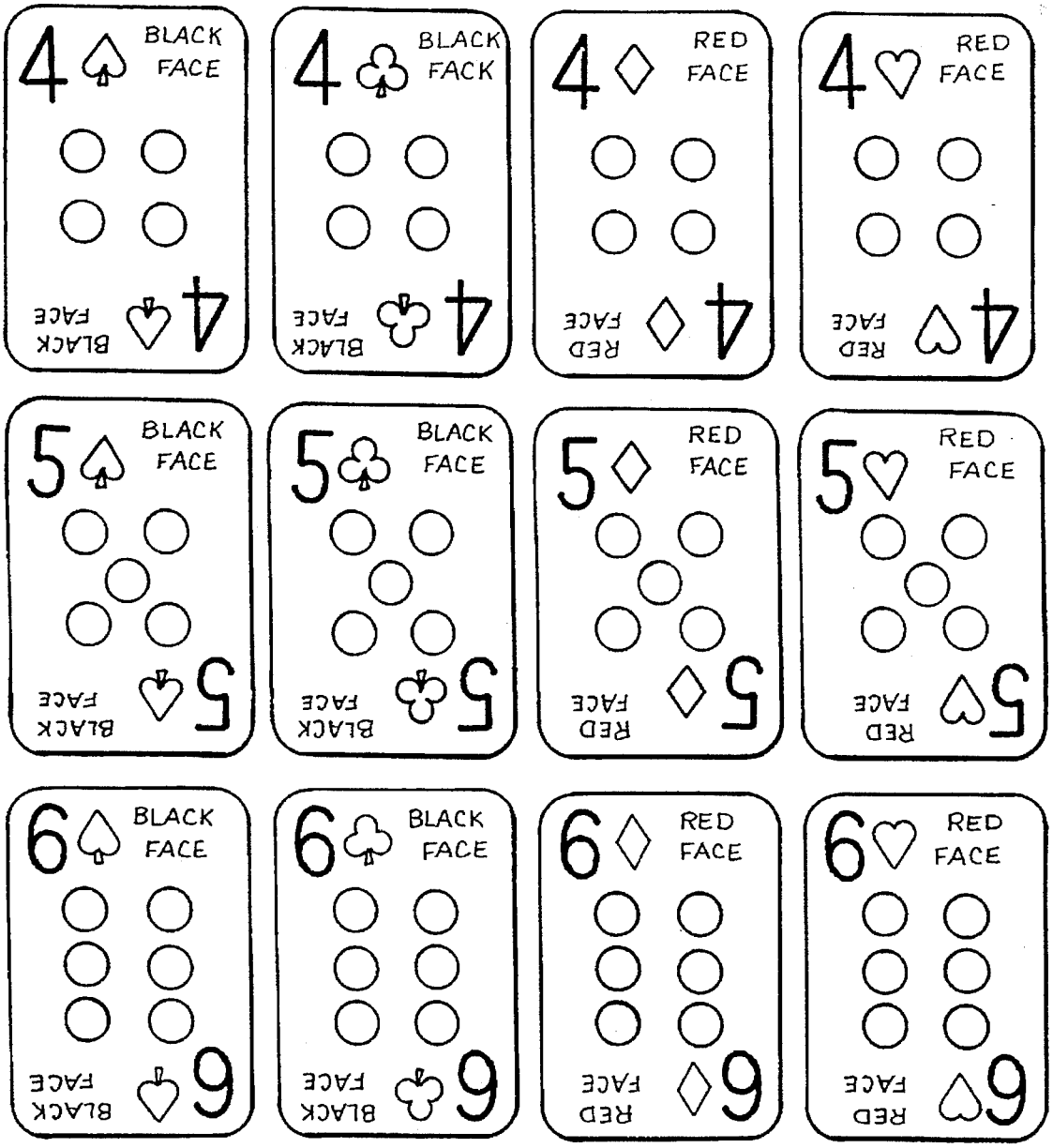
Figure 5A:
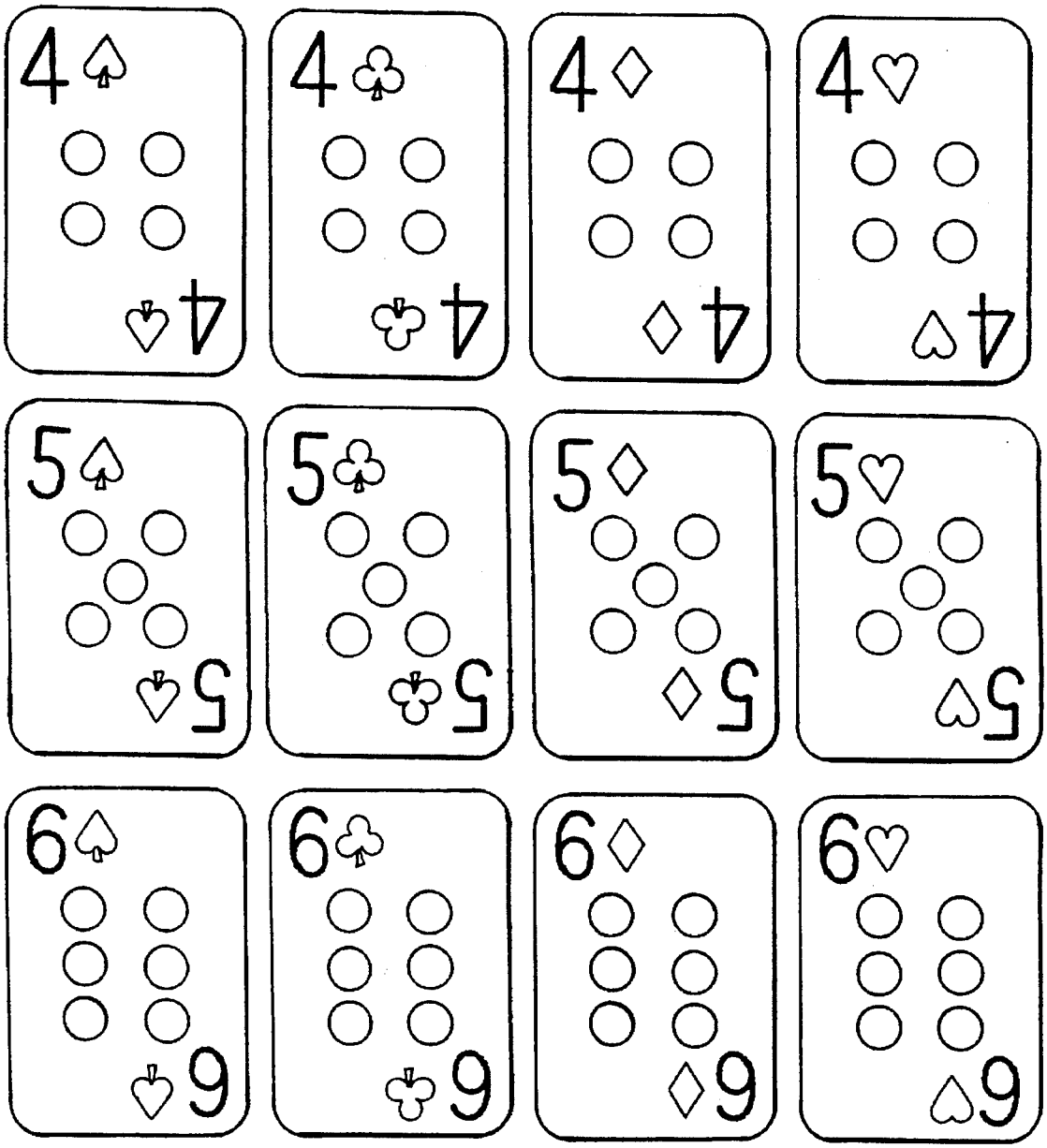
FIGS. 5*a* and 5*b* show a 36 card deck according to a second preferred embodiment of the present invention.
Figure 5B:
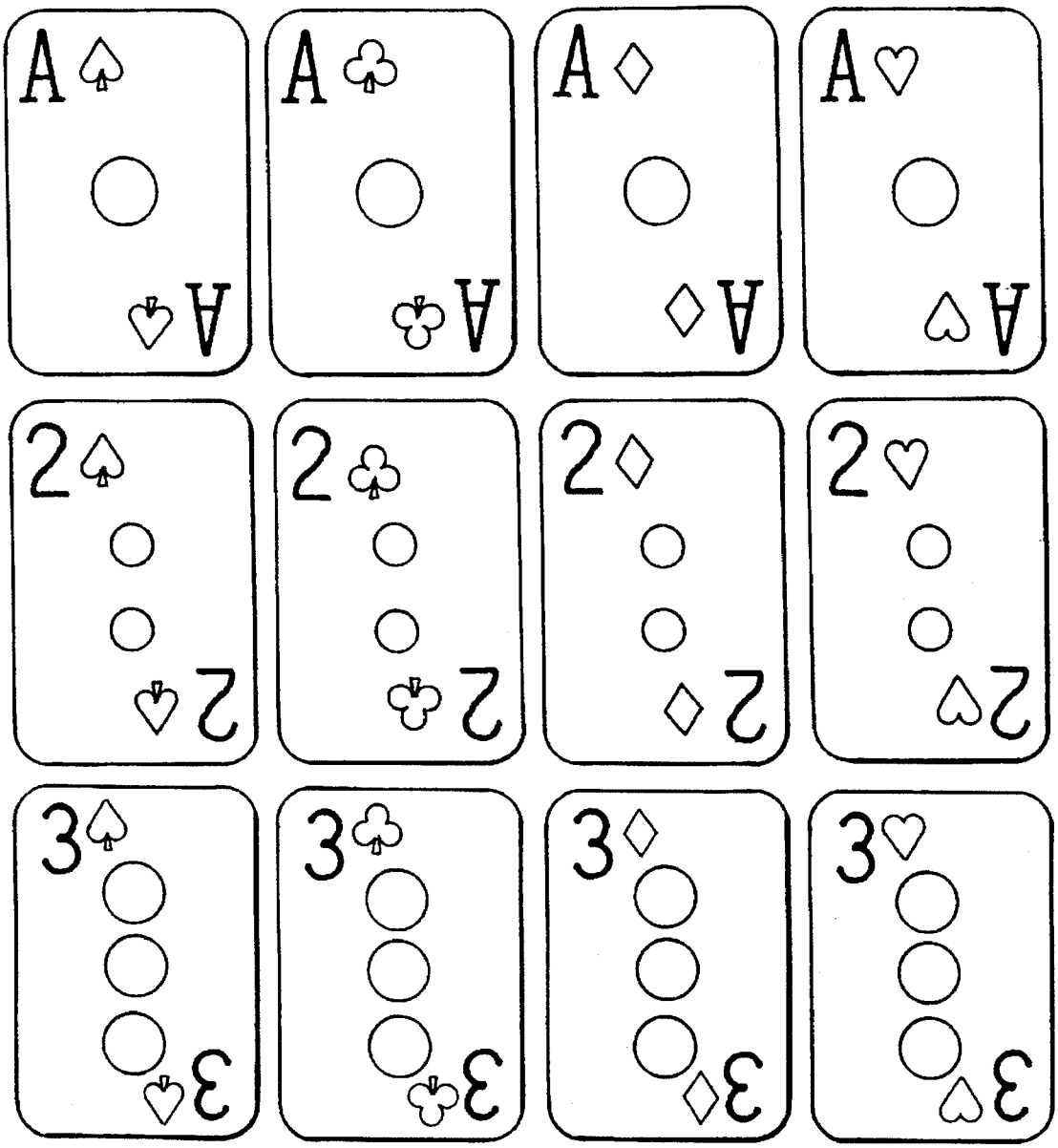

FIGS. 4*a* and 4*b* show a 36 card deck according to a first preferred embodiment of the present invention. According to this first preferred embodiment, all of the Hearts and Diamond cards are printed in only red and white, and all of the Spades and Clubs cards are printed in only black and white. The Hearts and Diamonds cards of FIGS. 4*a* and 4*b* are preferably white, with red indicia printed thereon. Similarly, the Spades and Clubs cards are printed with a white background and black indicia thereon. FIGS. 5*a* and 5*b* show another 36 card deck according to a second preferred embodiment of the present invention. The Hearts and Diamonds cards are printed with a red background and white indicia thereon, and the Spades and Clubs cards are printed with a black background and white indicia thereon.

The card shoe 12 accommodates a unique deck of 360 cards. Although the method of the presently preferred embodiment may be similar to the commonly-played game of Blackjack in that the goal of the game is to reach a predetermined number of points, the specific deck of cards and other various rules provide significant distinguishing features over this prior art. For example, the deck of 360 cards consists of 10 modified conventional card decks. Each conventional deck has aces, twos, threes, fours, fives, sixes, Jacks, Queens and Kings of Spades, Hearts, Diamonds and Clubs, but does not have any seven, eight, nine and ten cards. Each deck has 36 cards only; aces count as one point, suit cards count as zero, and other cards are counted as their face value. Alternatively, a conventional 52 card deck, a deck with an added Joker(s), or a set of 24 tiles (corresponding to the 36 card deck) can be used.

According to the method of the presently preferred embodiment, each player places a wager in one or more of the wager circles 24 and a required fee and one or more of the collection circles 26, as described in copending application "Method of playing a Card Game," U.S. Ser. No. 08/376,406, by the same inventor of this application and another. The player to the immediate left of the house dealer's position is first assigned the bank button 16 to indicate that the first player is presently serving as banker. This first player serves as banker for two games, and then the bank button 16 is given to a player to the left of the first player for two games. There are two ways to play the game: the player banker can declare to play the game red or black. The other way to play the game depends on the total outcome of three shaken dice, where from three to ten is the red winning scheme and from eleven to eighteen is the black winning scheme. The house dealer then gives the cup and the dice to the player with the bank button 16 and that player rolls the dice to determine assignment of the action button 18. If the sum of the three rolled dice is five, for example, a player five positions to the left of the banker player position 16 receives the action button 18. Alternatively, button 18 may be located by a value of the first card drawn from the shoe. For example, if the card of five is drawn, then button 18 is positioned as above.

The house dealer begins dealing cards to the players in a clockwise manner starting with the player having the action button 18. A total of three cards are dealt to each of the players, which totals three clockwise passes by the dealer. After these three passes, each player has three cards face down (including betting players and player banker). Alternatively, two cards are dealt if the game is played with a conventional 52 card deck.

The various players take their hands (each hand comprising three cards) and inspect them, determining whether an additional card is desirable. Beginning with the player to the left of the banker, players are given the opportunity to have additional cards dealt from the house dealer. If a player does not want additional cards, he places his cards in the stand box 30. On the other hand, if a player wishes to have an additional card dealt to him, then he places his cards in the hit box 28. The house dealer opens the banker's cards, placing them face up for all of the players to view, and the banker determines whether an additional card is desired for his hand.

According to the method of the presently preferred embodiment, the cards in the customized deck of 360 cards are assigned values according to the following scheme: all aces are counted as one, and numbered cards from two to six are counted as their indicated values. As presently preferred, suits of Hearts and Diamonds are considered as red suits and suits of Clubs and Spades are considered as black suits, but other combinations and schemes are possible. The objective of the game is to make a hand of red suits as close to nine for the red winning scheme, and to make a hand of black suits as close to nine for the black winning scheme. Thus, the best possible hand will have a total value of red-suit cards equalling nine points for the red game, and will have a total value of black-suit cards equalling nine for the black game.

Each player is thus originally dealt three cards, and has an option of taking a fourth card. If a player decides to take a fourth card and the resulting total of the player's four cards exceeds ten, then ten is automatically subtracted from the total of the player's hand. Thus, for example, a player may receive a five of Hearts, a four of Clubs and a Jack of Diamonds for the first three cards, and may decide to receive a fourth card. If this fourth card is a five of Diamonds, for example, then the original total would be one for the red winning scheme or four for the black winning scheme. Specifically, in this example, the red-suit total would be eleven, and the black-suit total would be four, as now described. According to the preferred embodiment, when the red winning scheme is used, ten is subtracted from the total of eleven red points, resulting in a score of one. If the black winning scheme were used in this example, then the total would be less than ten and the total would thus be four. The ranking order of this red winning scheme (with red suits only) is as follows: nine, eight, seven, six, five, four, three, two, one and zero. Black cards do not count at all. A similar ranking follows with the black winning scheme. The ranking order for the black winning scheme (with black suits only) is as follows: nine, eight, seven, six, five, four, three, two, one, and zero. All the red suits of cards do not count at all.

According to the present invention, once a winning scheme has been determined, the winning scheme applies to all of the players. After each player is dealt the first three cards face down, each player can decide whether to accept one additional card in an attempt to improve their hands. The logical determination of whether the banker should accept this fourth card or not is now described. If the red winning scheme is set, the banker must hit on a total of four red or lower, and must stay on a total of seven red or better. The banker has an option to accept a fourth additional card when the first three cards add up to five or six red for the red winning scheme. According to the presently preferred embodiment, the black determination is identical to the red determination, except that only black cards are counted. Specifically, in the black winning scheme, the banker must hit on four black or lower, and must stay on a total of seven black or better. According to this winning scheme, the banker has an option of hitting on five black or six black for the black winning scheme. The logical procedure for determining whether a betting player should accept a third card or not, is essentially the same for both winning schemes and is now described. For the red winning scheme, the betting player should hit on four red or lower, and should stay on five red or better. When the black winning scheme is being implemented, the betting player should hit on four black or lower, and should stay on five black or better Since the player having the action button 18 is allowed to compare his cards with those of the player having the bank button 16 first, the player having the action button 18 has the highest probability of winning or losing money. The amount of money represented by chips in the wager circles 24 in front of the player having the bank button 16 represents the total amount of money available to be won during any given game. Thus, if the player having the action button 18 wins all of the money in the banker's wager circles 24, then there is no money left for the other players to win. Accordingly, the other players are entitled to a refund of the money in their collection circles 27. Details of this protocol are described in copending application "Method of playing a Card Game," Ser. No. 08/376,406, by one of the same inventors of this application.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A method of playing a card game among a plurality of players arranged in a circular fashion, a dealer being positioned between two of the players, the method comprising the following steps:

providing a composite deck of cards, the composite deck of cards comprising at least one modified deck of cards which is modified by removing all seven, eight, nine, and ten cards from a conventional deck of cards; having red and black suits;

placing a wager by each of the players;

a first player among the plurality of players being assigned the title of banker;

determining whether a first winning scheme is to be commonly used by all the players and banker or a second winning scheme is to be used;

providing at least one decision piece to the banker, the banker using the decision piece to determine an assignment of an action button;

assigning to a second player among the plurality of players the action button, the assignment of the action button to the second player being based upon a number generated by the use of the decision piece dealing by the dealer a first round of at least one card to each of the plurality of players in rotation determining by each of the players whether zero or at least one additional card is desired;

dealing by the dealer a second round of cards to any player in rotation who wants a card; and comparing the hands of the banker to each of the players' hands and declaring as winners players having hands that meet the determined winning scheme, wherein the first winning scheme is a "red" winning scheme that assigns a higher value to cards in a red suit when the hands are compared, and that assigns a lower value to cards in a black suit when the hands are compared, and wherein the second winning scheme is a "black" winning scheme that assigns a higher value to cards in a black suit when the hands are compared, and that assigns a lower value to cards in a red suit when the hands are compared.

2. The method of playing a card game among a plurality of players according to claim 1, wherein the red winning scheme assigns priority to red suits cards only, and assigns a "best hand" to be a total of nine, and a "worst hand" to be a hand without red suits, the red winning scheme being set forth fully from best to worst, in descending order, as follows: nine, eight, seven, six, five, four, three, two, one, and zero wherein the first round of at least one card comprises three cards.

3. The method of playing a card game among a plurality of players according to claim 2, wherein the black winning scheme assigns priority to black suits cards only, and assigns a "best hand" to be a total of nine, and a "worst hand" to be a hand without black suits, the black winning scheme being set forth fully from best to worst, in descending order, as follows: nine, eight, seven, six, five, four, three, two, one, and zero.

4. The method of playing a card game among a plurality of players according to claim 3, wherein a sum greater than or equal to ten automatically has ten subtracted therefrom.

5. A method of playing a card game among a plurality of players arranged in a circular fashion, a dealer being positioned between two of the players, the method comprising the following steps:

providing a composite deck of cards, the composite deck of cards corresponding at least in part to at least one conventional deck of cards having first colored images and second colored images;

placing a wager by each of the players;

a first player among the plurality of players being assigned the title of banker;

determining whether a first colored winning scheme is to be commonly used by all the players and banker or a second winning scheme is to be commonly used by all the players and banker;

providing at least one colored decision piece to the banker, the banker using the decision piece to determine an assignment of an action button;

assigning to a second player among the plurality of players the action button, the assignment of the action button to the second player being based upon a number generated by the use of the decision piece;

dealing by the dealer a first round of at least one card to each of the plurality of players in rotation determining by each of the players whether zero or at least one additional card is desired;

dealing by the dealer a second round of cards to any player in rotation who wants a card; and comparing the hands of the banker to each of the players' hands and declaring as winners players having hands that meet the determined winning scheme.

6. The method according to claim 5 wherein the composite deck of cards is a conventional 52 card deck wherein the first round of at least one card comprises three cards.

7. The method according to claim 5 wherein the conventional deck of cards further includes a joker card.

8. A method of playing a card game among a plurality of players arranged in a circular fashion, a dealer being positioned between two of the players, the method comprising the following steps:

providing a composite deck of cards, the composite deck of cards corresponding at least in part to at least one modified deck of cards having red and black suits which is modified by removing all seven, eight, nine, and ten cards from a conventional deck of cards;

placing a wager by each of the players;

a first player among the plurality of players being assigned the title of banker;

determining whether a first winning scheme is to be used or a second winning scheme is to be used;

providing at least one decision piece to the banker, the banker using the decision piece to determine an assignment of an action button;

assigning to a second player among the plurality of players the action button, the assignment of the action button to the second player being based upon a number generated by the use of the decision piece;

dealing by the dealer a first round of at least one card to each of the plurality of players in rotations determining by each of the players whether zero or at least one additional card is desired;

dealing by the dealer a second round of cards to any player in rotation who wants a card; and comparing the hands of the banker to each of the players' hands and declaring as winners players having hands that meet the determined winning scheme, wherein the first winning scheme is a "red" winning scheme that assigns a higher priority to cards in a red suit when the hands are compared, and that assigns a lower priority to cards in a black suit when the hands are compared, and that also assigns a higher priority to greater sums of cards than to smaller sums of cards, the red winning scheme assigning a "best hand" to be a total of nine red, and a "worst hand" to be a hand without red suits cards, the red winning scheme (with red suits cards only) being set forth fully from best to worst, in descending order, as follows: nine, eight, seven, six, five, four, three, two, one and zero, wherein the second winning scheme is a "black" winning scheme that assigns a higher priority to cards in a black suit when the hands are compared, and that assigns a lower priority to cards in a red suit when the hands are compared, and that also assigns a higher priority to greater sums of cards than to smaller sums of cards, the black winning scheme assigning a "best hand" to be a total of nine black, and a "worst hand" to be a hand without black suits cards, the second winning scheme (with black suits cards only) being set forth fully from best to worst, in descending order, as follows: nine, eight, seven, six, five, four, three, two, one, and zero.

9. A method of playing a tile game among a plurality of players arranged in a circular fashion, a dealer being positioned between two of the players, the method comprising the following steps:

providing a composite set of tiles, the composite set of tiles corresponding at least in part to at least one modified set of tiles which is modified by removing all seven, eight, nine, and ten tiles from a conventional set of tiles having red and black suits;

placing a wager by each of the players;

a first player among the plurality of players being assigned the title of banker;

determining whether a first winning scheme is to be used or a second winning scheme is to be used;

providing at least one decision piece to the banker, the banker using the decision piece to determine an assignment of an action button;

assigning to a second player among the plurality of players the action button, the assignment of the action button to the second player being based upon a number generated by the use of the decision piece;

dealing by the dealer a first round of at least one tile to each of the plurality of players in rotation;

determining by each of the players whether zero or at least one additional tile is desired;

dealing by the dealer a second round of tiles to any player in rotation who wants a tile; and comparing the hands of the banker to each of the players' hands and declaring as winners players having hands that meet the determined winning scheme, wherein the first winning scheme is a "red" winning scheme that assigns a higher value to tiles in a red suit when the hands are compared, and that assigns a lower value to tiles in a black suit when the hands are compared, and wherein the second winning scheme is a "black" winning scheme that assigns a higher value to tiles in a black suit when the hands are compared, and that assigns a lower value to tiles in a red suit when the hands are compared.

10. A method of playing a tile game among a plurality of players arranged in a circular fashion, a dealer being positioned between two of the players, the method comprising the following steps:

providing a composite set of tiles, the composite set of tiles corresponding at least in part to at least one conventional deck of cards having first types of images and second types of images;

placing a wager by each of the players;

a first player among the plurality of players being assigned the title of banker;

determining whether a first type image winning scheme is to be commonly used by all the players and banker or a second winning scheme is to be commonly used by all the players and banker;

providing at least one decision piece to the banker, the banker using the decision piece to determine an assignment of an action button;

assigning to a second player among the plurality of players the action button, the assignment of the action button to the second player being based upon a number generated by the use of the decision piece;

dealing by the dealer a first round of at least one tile to each of the plurality of players in rotation determining by each of the players whether zero or at least one additional tile is desired;

dealing by the dealer a second round of tiles to any player in rotation who wants a tile; and comparing the hands of the banker to each of the players' hands and declaring as winners players having hands that meet the determined winning scheme.

11. A method of playing a card game among a plurality of players arranged in a circular fashion, a dealer being positioned between two of the players, the method comprising the following steps:

providing a composite deck of cards, the composite deck of cards corresponding at least in part to at least one conventional deck of cards having red and black suits;

placing a wager by each of the players;

a first player among the plurality of players being assigned the title of banker;

determining whether a red-suit winning scheme where only Heart and Diamond cards are counted, or a black-suit winning scheme where only Spades and Clubs are counted is to be used;

providing at least one decision piece to the banker, the banker using the decision piece to determine an assignment of an action button;

assigning to a second player among the plurality of players the action button, the assignment of the action button to the second player being based upon a number generated by the use of the decision;

dealing by the dealer a first round of at least one card to each of the plurality of players in rotation determining by each of the players whether zero or at least one additional card is desired;

dealing by the dealer a second round of cards to any player in rotation who wants a card; and comparing the hands of the banker to each of the players' hands and declaring as winners players having hands that meet the determined winning scheme.

12. A method of playing a card game among a plurality of players arranged in a circular fashion, a dealer being positioned between two of the players, the method comprising the following steps:

providing a composite deck of cards, the composite deck of cards corresponding at least in part to at least one conventional deck of cards having red and black suits;

placing a wager by each of the players;

a first player among the plurality of players being assigned the title of banker;

determining which one of four winning schemes is to be used, the first winning scheme counting only Heart cards, the second winning scheme counting only Club cards, the third winning scheme counting only Spade cards, and the fourth winning scheme counting only Diamond cards;

providing at least one decision piece to the banker, the banker using the decision piece to determine an assignment of an action button;

assigning to a second player among the plurality of players the action button, the assignment of the action button to the second player being based upon a number generated by the use of the decision piece ;

dealing by the dealer a first round of at least one card to each of the plurality of players in rotation determining by each of the players whether zero or at least one additional card is desired;

dealing by the dealer a second round of cards to any player in rotation who wants a card; and comparing the hands of the banker to each of the players' hands and declaring as winners players having hands that meet the determined winning scheme.

* * * * *